United States Patent [19]

Campbell, Jr.

[11] Patent Number: 5,024,128

[45] Date of Patent: Jun. 18, 1991

[54] SHEETER FOR WEB FED PRINTING PRESS

[76] Inventor: Gaines P. Campbell, Jr., 227 Fleetwood Dr., Lookout Mountain, Tenn. 37350

[21] Appl. No.: 312,913

[22] Filed: Feb. 21, 1989

[51] Int. Cl.[5] ..... B26D 1/56

[52] U.S. Cl. ..... 83/26; 83/37; 83/107; 83/110; 83/150; 83/151; 83/343

[58] Field of Search ..... 83/26, 37, 89, 102, 83/110, 136, 150, 151, 311, 300, 339, 343, 346, 347, 594, 312, 107, 42

[56] References Cited

U.S. PATENT DOCUMENTS

| | | | |
|---|---|---|---|
| 2,499,570 | 3/1950 | Crafts | 83/110 |
| 3,279,290 | 10/1966 | Stemmler | 83/26 |
| 4,480,516 | 11/1984 | Leroy | 83/110 |
| 4,905,599 | 3/1990 | Richey | 83/151 |

*Primary Examiner*—Hien H. Phan
*Assistant Examiner*—Scott A. Smith
*Attorney, Agent, or Firm*—Stevens, Davis, Miller & Mosher

[57] ABSTRACT

A sheeter for a web fed printing press having:

an infeed section;

a first cutting head into which the infeed section feeds the web, the first cutting head for cutting the web transversely comprising a circular knife cylinder and corresponding anvil cylinder having circumferences larger than the repeat length of the press;

a sheet transfer section having rollers, which moves the cut web from the first cutting head to a second cutting head;

the second cutting head comprising a circular knife cylinder and corresponding anvil cylinder to cut a chip from the cut web, a motor to rotate the first and second cutting heads and sheet transfer section rollers at the same surface speed; and nip rollers to deliver the finished product from the second cutting head to a delivery system.

The second cutting head can be rotated with respect to the first cutting head so that the length of the chip can be increased or decreased. Also, the first and second cutting heads can be but a single cutting head composed of two cooperating knife/anvil cylinders.

5 Claims, 2 Drawing Sheets

SHEETER FOR WEB FED PRINTING PRESS

BACKGROUND OF THE INVENTION

This invention relates to a sheeter for a web fed printing press for cutting a continuous web of paper transversely, and more specifically to a sheeter having two cutting heads which work in unison wherein the first cutting head cuts the web to a predetermined length and the second cutting head cuts and removes a chip from the cut web, to produce cut webs of desired length from a continuous web.

The invention also relates to a sheeter for a web fed printing press wherein the first and second cutting heads are but a single cutting head comprised of two cooperating knife/anvil cylinders.

U.S. Pat. No. 118,327 to Arkell relates to a device for cutting paper. The device consists of a feed roller assembly and a knife roller assembly. In a preferred embodiment, the circumference of the roller supporting the knife is greater than the circumference of the feed roller, so that the knife moves faster than the paper exiting the feed roller.

U.S. Pat. No. 309,433 to Baillie relates to the use of two sets of rolls and anvils in forming cardboard dividers for egg cartons. A first roll/anvil forms slits in a traveling web, said slits being parallel to the moving path of the web. The second roll/anvil, downstream of the first, removes strips from the web by making cuts on the web transverse to the moving path of the web.

U.S. Pat. No. 3,182,540 to Eichorn et al is directed to a cutter having a plurality of cutting knives disposed about its surface to cut paper forms of 3, 4, 6 or 12 inches. Two adjacent knives are used to cut the strip (chip) between pieces. Eichorn et al provide a platen roll having a dial-a-matic capacity which raises specific areas of the platen to register with the knives of the knife roll and produce a web of the desired length.

U.S. Pat. No. 2,110,901 to Zuckerman relates to a web cutting mechanism for printing machines. The mechanism is equipped with a plurality of pairs of cooperating cutting cylinders, each pair being of a different diameter so that the appropriate pair is selected for use based on the length of product desired.

U.S. Pat. No. 1,867,335 to Strecker is directed to an improvement in a cross cutter for uniformly moving webs of paper. The improvement is that the variable speed gearing of the cross cutter includes a vertical driving and driven shaft.

U.S. Pat. No. 4,381,688 to Hardy relates to a die cutter for a rotary machine, particularly for use in the production of die cut self-adhesive labels. The die cutter comprises a hollow open ended cylinder which can be mounted on a rotatable shaft and axially adjusted relative to the shaft to adjust the spacing between the cylinder and other like cylinders also mounted on the shaft.

U.S. Pat. No. 435,355 to Cox is directed to a machine for perforating a continuous web of paper at regular intervals into sheets of varying lengths. The perforating machine consists essentially of a series of adjustable perforating rolls, either of which can be readily adjusted to operated upon the paper, in combination with an impact cylinder or roll coacting therewith. The perforating roll is journaled in revoluble supports beneath the impact roll and operates therewith.

U.S. Pat. No. 4,699,033 to Gherardi relates to a device for dividing a continuous web of wrapping material into successive single sections of the same length, particularly for use in the manufacturing of filter-tipped cigarettes. Excessive noise produced by the blades hitting against the anvil is reduced by securing the blades onto a projecting blade-carrying member which by elastic deformation is elastically yieldable in the radial direction toward the axis of a shaft for rotating the cutting roller.

The subject matter of the U.S. patents discussed above is incorporated by reference herein.

Known sheeters have the following disadvantages. The set-up of the known apparatus for different sized sheets is time-consuming. The chip remover cuts a predetermined width which may be varied but only by a lengthly rearrangement of the chip removal blade. The chip if incompletely cut hangs onto the finished product to cause jam-ups in the sheeter.

SUMMARY OF THE INVENTION

An object of the present invention is to provide an apparatus to accommodate easily for different sized sheets.

Another object of the invention is to provide an apparatus to accommodate easily for different sizes of chip to be removed.

A further object of the invention is to provide an apparatus to remove easily the incompletely clean cut chip.

A still further object of the invention is to provide a novel improved sheeter.

Another object of the invention is to provide an improved sheeter to cut varied width chips.

A further object of the invention is to provide a process for more easily and faster obtaining finished printed pieces.

The present invention relates to a sheeter for a web fed printing press comprising an infeed section, a first cutting head, a sheet transfer section, a second cutting head and nip rollers. The web is cut transversely by the first and second cutting heads. The chip is removed by the second cutting head while the finished piece is removed by the nip rollers. The first and second cutting heads also can be but a single cutting head composed of two cooperating knife/anvil cylinders.

The features of the invention and the advantages thereof will appear in more detail from the following description of a preferred embodiment of the present invention and the accompanying drawings.

DESCRIPTION OF THE PREFERRED EMBODIMENT

Figure 1:
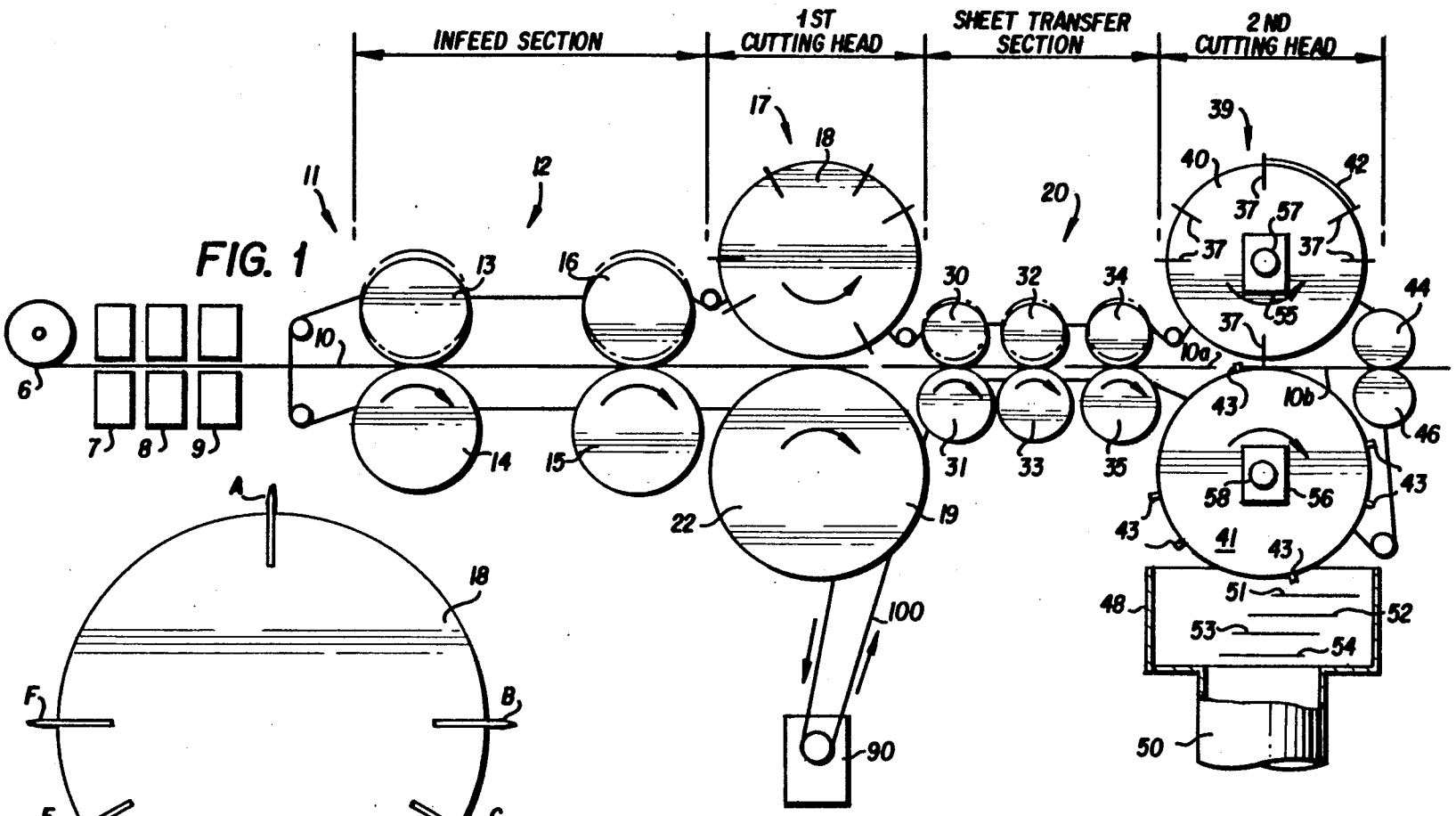
FIG. 1 is a schematic view of a web fed printing press including sheeter of the present invention.

In FIG. 1, a roll of paper 6 is fed to the printer 7, oven 8 and finisher 9 in the form of a continuous web 10. Following the finisher 9 the web 10 is fed into the sheeter 11 at the infeed section 12. Infeed rollers 13, 14, 15 and 16 feed the continuous web 10 to the first cutting head 17.

Figure 2:
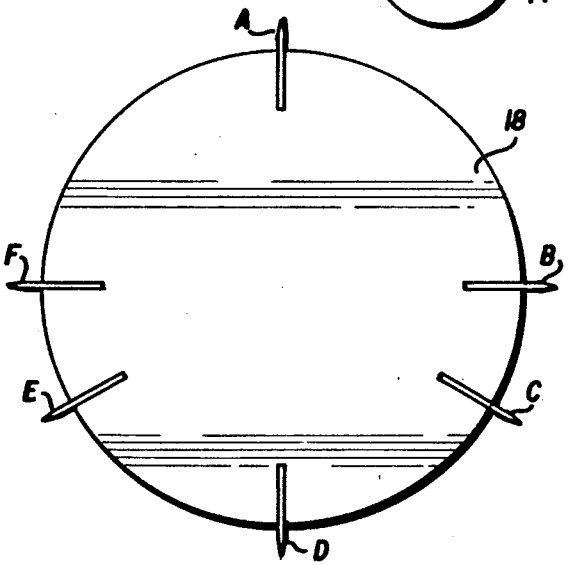
FIG. 2 is an enlarged view of a knife cylinder of the first cutting means of FIG. 1.

The first cutting head 17 comprises a knife cylinder 18 and a corresponding anvil cylinder 19, each of which has a circumference larger than the repeat length of the press. The arrangement of 18 and 19 can, of course, be reversed. The web 10 passes between knife cylinder 18 and anvil cylinder 19. The blades A, B, C, D, E and F of knife cylinder 18 (FIG. 2) are arranged depending on the length of web desired. Once the length of the web is selected with the respective blade the remaining blades are removed.

The web 10 passes through the first cutting head 17 and is held by the sheet transfer section 20, composed of rollers 30, 31, 32, 33, 34 and 35, prior to being cut. The nip rollers 30, 31 engage the web 10 immediately before the knife cylinder 18 makes the cut. This insures control of the cut web 10*a* by the nip rollers 30 and 31 after the cut is made. The cut web 10*a* is then fed into the second cutting head 39 and passes between knife cylinder 40 and the corresponding anvil cylinder 41. As the cut web 10*a* is fed into the second cutting head 39, rubber pads 42, which are situated between the knives 37 of cylinder 40, nip the web 10*a* between the pads 42 and the anvil cylinder 41. Pins 43 protruding from the anvil cylinder 41 pierce the web chips 51–54, the cut is made, and the finished piece 10*b* is delivered to the nip rollers 44 and 46. The chips 51–54 secured to the pins 43 of the anvil cylinder 41 after cutting are disposed of by the disposal means 48 and 50. The finished product is then delivered by the nip rollers 44 and 46 into a delivery system (not shown).

Motor 90 moves endless chain 100 which moves the infeed rollers, the first and second cutting heads, the sheet transfer section and nip rollers 44, 46 at the same time.

The second cutting head 39 ca be rotated with respect to the first cutting by means of phase changing devices 55 and 56 on shafts 57 and 58 respectively, so that the length of chip can be increased or decreased. The phase change may be made while the sheeter is running. Knife cylinder 40 and anvil cylinder 41 operate in unison.

In practicing the invention the surface speed of the first and second cutting heads and sheet transfer section is greater than the surface speed of the infeed section 12 to allow for the cut web 10*a* to move away cleanly from the web 10. The surface speed of nip rollers 44 and 46 is greater than the surface speed of the first and second cutting heads and sheet transfer section which have the same surface speed to enable the finished piece to be moved away cleanly to a delivery system.

As an example, consider a web fed printing press in which the repeat length is 18 inches. The sheeter according to the present invention can cut the web into lengths divisible into 18 inches, cuts being made for lengths of webs of 18 inches (full cut), 9 inches ($\frac{1}{2}$ cut), 6 inches ($\frac{1}{3}$ cut), and $4\frac{1}{2}$ inches ($\frac{1}{4}$ cut) in length. (See knife cylinder 18 in FIG. 2.) For a full cut, blades B, C, D, E and F are removed. For a $\frac{1}{2}$ cut, blades B, C, E and F are removed. Blades B, D and F are removed for a $\frac{1}{3}$ cut, and blades C and E for a $\frac{1}{4}$ cut.

Additionally, the knife cylinder and anvil cylinder each have a circumference larger than the repeat length of the press (in this example, 18 inches). In this specific embodiment, the cylinders each have a circumference of 20 inches. The surface speed of the cylinders runs faster than the surface speed of the web (in this case 1.1667 times faster). This insures that the cuts are made at the proper intervals and allows the surface speed of the paper to be increased each time after the paper is cut, which prevents the cut webs from jamming the sheeter.

Figure 3:
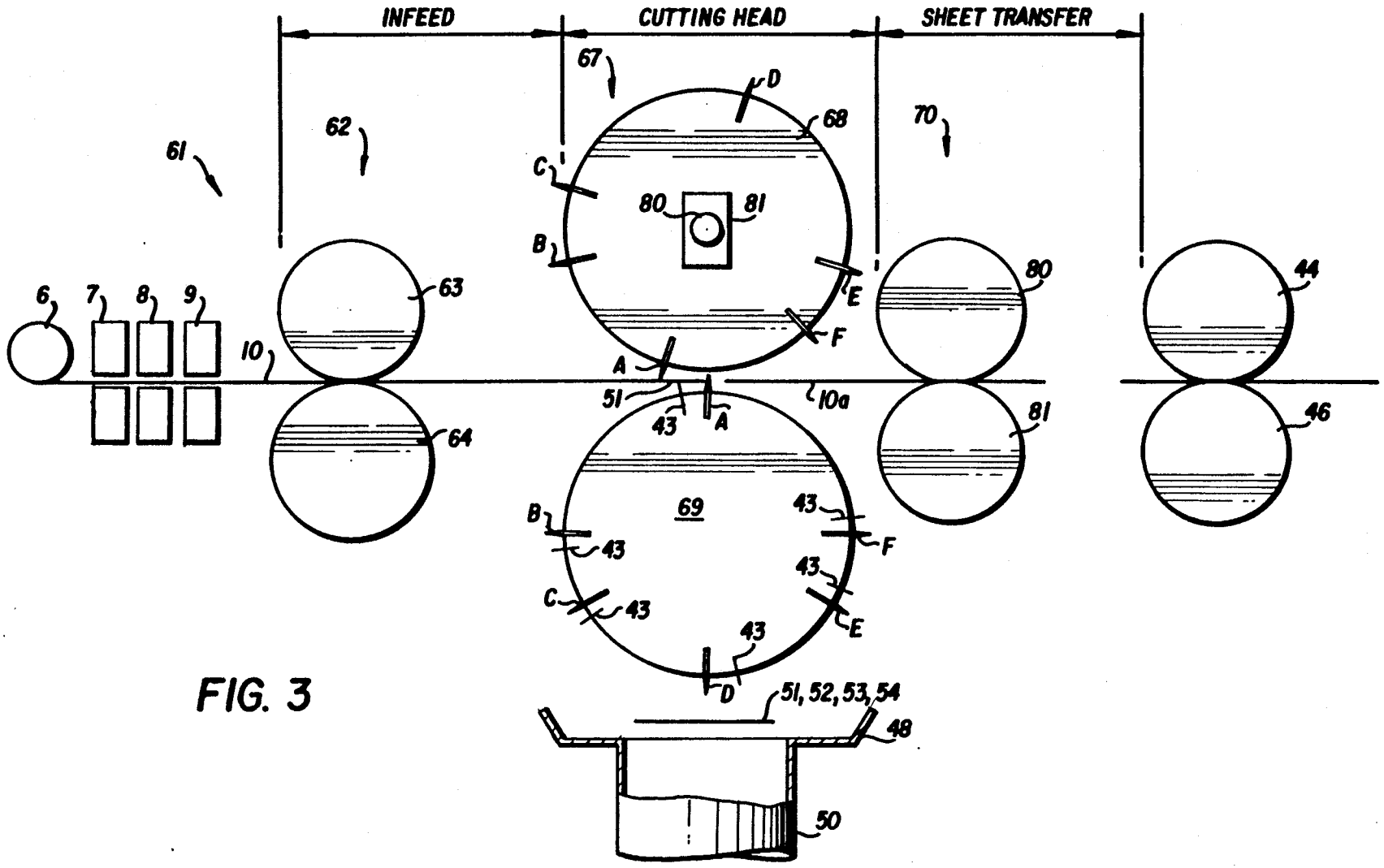
FIG. 3 is a schematic view of a second embodiment of the sheeter of the present invention.

In FIG. 3 a roll of paper 6 is fed to the printer 7, oven 8 and finisher 9 in the form of a continuous web 10. Following the finisher 9 the web 10 is fed into the sheeter 61 at the infeed section 62. Infeed rollers 63 and 64 feed the continuous web 10 to the cutting head 67.

Cutting head 67 comprises a knife/anvil cylinder 68 and a corresponding knife/anvil cylinder 69, each of which has a circumference larger than the repeat length of the press. The web 10 passes between knife anvil cylinder 68 and knife/anvil cylinder 69. The blades A, B, C, D, E and F of knife/anvil cylinders 68 and 69 are arranged such that different blades are removed depending on the length of web desired. Knife/anvil cylinder 68 can be rotated on shaft 80 by a phase changing device 81, known in the art, relative to knife/anvil cylinder 69 to vary the cut length of web chip 51. The phase change may be made while the sheeter is running.

The web 10 passes through cutting head 67 and is held by the sheet transfer section 70 prior to being cut. The nip rollers 80 and 81 engage the web 10 immediately before the knife cylinder 69 makes the cut. This insures control of the cut web 10A by the nip rollers 80 and 81 after the cut is made.

The cut web is then delivered by the nip rollers 44 and 46 into a delivery system (not shown). Pins 43 protruding from the knife/anvil cylinder 69 pierce the web chip 51. The web chip 51 is cut from web 10 by knife-/anvil cylinder 68. The web chip 51 secured to the pins 43 are disposed of by the disposal means 48 and 50.

A motor moves infeed section 62, cutting head section 67 and sheet transfer section 70 at the same time in the same way as in FIG. 1.

In practicing the invention the surface speed of the cutting heads and sheet transfer section is greater than the surface speed of the infeed section 62 to allow for the cut web 10A to move away cleanly from the web 10. The surface speed of nip rollers 44 and 46 is greater than the surface speed of the cutting heads and sheet transfer section, which have the same surface speed, to enable the finished piece to be moved away cleanly to a delivery system. FIG. 3 is the preferred embodiment.

What is claimed:

1. A method of cutting a web containing a plurality of portions of predetermined length fed through a printing press comprising:

feeding a continuous web into a first cutting head at a first surface speed;

cutting the web transversely by said first cutting head rotating at a second higher surface speed to form a separated portion and an uncut portion of said web;

feeding the uncut portion of said web into a second cutting head rotating at said second higher surface speed; cutting said uncut portion of said web with said second cutting head to form a separated portion of predetermined length and a further uncut portion;

cutting a chip from the further uncut portion of said web by said first cutting head; removing said chip by said second cutting head; and removing said separated portion of predetermined length to a delivery system at a third surface speed higher than said first and second surface speeds.

2. The method of claim 1 including rotating one of the first cutting head and second cutting head relative to the other to vary the length of the chip.

3. The method of claim 1 wherein said separated portion of predetermined length is a printed portion on a paper web.

4. A method of cutting a web containing portions of print of predetermined length fed through a printing press comprising:

feeding a continuous web of paper having printed portions of predetermined length therein into a cutting head at a first surface speed, said cutting head having upper and lower knife/anvil cylinders;

cutting the web transversely by said upper knife anvil/cylinder rotating at a second higher surface speed to form an end of a printed portion of predetermined length;

cutting from said web a printed portion of predetermined length by said lower knife/anvil cylinder rotating at said second higher surface speed; cutting a chip from said web by said upper knife/anvil cylinder; removing said chip by said lower knife/anvil cylinder; and removing said cut printed portion of predetermined length to a delivery system at a third surface speed higher than said first and second surface speeds.

5. The method of claim 4 including rotating one of the upper knife/anvil cylinder and lower knife/anvil cylinder relative to the other to vary the length of the chip.

* * * * *